United States Patent [19]

Senga et al.

[11] Patent Number: 4,873,166

[45] Date of Patent: Oct. 10, 1989

[54] LIQUID DEVELOPER FOR ELECTROPHOTOGRAPHY

[75] Inventors: Takao Senga; Kazuchiyo Takaoka; Hirokazu Yamamoto; Takimi Hashimoto, all of Nagaokakyo, Japan

[73] Assignee: Mitsubishi Paper Mills, Ltd., Tokyo, Japan

[21] Appl. No.: 33,002

[22] Filed: Mar. 31, 1987

[30] Foreign Application Priority Data

| | | | |
|---|---|---|---|
| Mar. 31, 1986 | [JP] | Japan | 61-74505 |
| Mar. 31, 1986 | [JP] | Japan | 61-74507 |
| Apr. 2, 1986 | [JP] | Japan | 61-77358 |
| Jan. 19, 1987 | [JP] | Japan | 62-11087 |
| Jan. 20, 1987 | [JP] | Japan | 62-11743 |

[51] Int. Cl.[4] ..... G03G 9/12; G03G 11/00

[52] U.S. Cl. ..... 430/137; 430/114; 524/533

[58] Field of Search ..... 430/137, 114, 115; 524/533

[56] References Cited

U.S. PATENT DOCUMENTS

| | | | |
|---|---|---|---|
| 3,657,130 | 4/1972 | Machida et al. | 430/137 |
| 4,636,452 | 1/1987 | Furukawa et al. | 430/114 X |

*Primary Examiner*—J. David Welsh

*Attorney, Agent, or Firm*—Cushman, Darby & Cushman

[57] ABSTRACT

Disclosed is a process for producing a liquid developer for electrostatic photography which comprises a highly insulating hydrocarbon medium and resin particles dispersed therein, said process comprising polymerizing a monomer (A) soluble in said medium, but insolubilized upon being polymerized in the presence of a polymer (S) insoluble in said medium and having a carboxyl group, a hydroxyl group or an amide group. In this process, a monomer (B) soluble in said medium and still soluble upon being polymerization and/or a monomer (C) having at least two polymerizable unsaturated double bonds may also be polyumerized.

14 Claims, No Drawings

LIQUID DEVELOPER FOR ELECTROPHOTOGRAPHY

BACKGROUND OF THE INVENTION

This invention relates to a liquid developer for development of electrostatic latent images such as in electrophotography or electrostatic recording and more particularly, it relates to a liquid developer which is excellent in preservation property, stability and fixability and especially can provide images of high quality.

There have been known a number of liquid developers for development of electrostatic latent images. For example, the well known method comprises mechanically dispersing colorants, pigments or dyes such as carbon black, cyanine blue, nigrosine, oil dyes, etc. in a highly insulating medium together with resins such as rosin, alkyd resins, acrylic resins, synthetic rubbers, etc. by a ball mill, an attritor, a homogenizer, etc. and further adding a metallic soap, an amine, a higher fatty acid, etc. to stably give electric charges to the dispersed particles of the dispersion.

However, the liquid developer obtained by the above method has the defect that since the dispersed particles as a developer have a broad distribution of their diameter, a lot of precipitates are produced, it is inferior in charge stability and production stability and stable images are obtained with difficulty.

Japanese Patent Examined Publication Nos. 54029/78 and 12985/82 disclose a method which comprises previously introducing a polymerizable vinyl group into a precursor polymer, polymerizing a monomer in the presence of said precursor polymer to produce a graft copolymer and coloring this graft copolymer with a dye. This method, although being excellent, still has problems in control of introduction of vinyl group and reproducibility and often causes formation of gel or sometimes it is difficult to stably produce dispersed particles resulting in formation of coarse particles of more than 1μ or fine particles of less than 0.1μ. These are not preferred in practical use.

Furthermore, Japanese Patent Unexamined Publication Nos. 83174/84, 177572/84, 212850/84, 212851/84, 164757/85, 179751/85, 185962/85, 185963/85, 252367/85, 116364/86, 116365/86, etc. disclose use of resin dispersion as a liquid developer which is produced by polymerizing a monomer which is soluble in a highly insulating medium in the presence of a polymer soluble in said medium, but becomes insoluble therein upon being polymerized. This method is excellent in stability, in industrial production an in dispersion stability. However, when images are formed on an electrostatic recording material by coulombic force using a liquid developer prepared from the resin obtained by this method, there occur electrostatic mutual repulsion due to coulombic force of the dispersed particles per se and excluded volume effect caused by repulsion due to increase in concentration of dispersed and stabilized polymer. Therefore, there is the defect that with decrease in effective surface potential of electrostatic recording material, blurred ghosts are apt to occur around images. There is another defect that when the liquid developer prepared from the resins obtained by the above method is continuously used with replenishment of the developer, solvent soluble resin is accumulated to affect the charge quantity of dispersed particles, although it depends on the kind of the soluble resin.

Moreover, in order to use the developer for preparation of printing plate where toner images as referred to hereinafter is functioned as a resist layer, the toner particles are preferably internally crosslinked because a resist layer formed of particles having crosslinked structure by fixation and film-formation has a high resisting ability and can provide goo printing plates. None of the conventional wet developers satisfy all of these characteristics.

SUMMARY OF THE INVENTION

It is an object of this invention to provide a liquid developer which is free from the above defects and especially a liquid developer which can produce clear images with no blurred ghost around of them and cause less deterioration of images even after continuous use of long period.

It is a further object of this invention to provide a liquid developer which provides excellent printing quality when used as a developer for preparation of offset printing plate using zinc oxide or organic semiconductor as a photoreceptor.

It is a still further object of this invention to provide a liquid developer for preparation of printing plates which includes toner particles having internal crosslinked structure and exhibits excellent resist property against dissolving solution of high permeability which comprises benzyl alcohol, butyl alcohol, etc.

DESCRIPTION OF THE INVENTION

The first construction of this invention comprises a liquid developer for electrostatic photography which comprises a high insulating hydrocarbon medium and resin particles at least dispersed in the medium, wherein said resin is a resin dispersion obtained by polymerizing the following monomer (A) or additionally the following monomer (C) in the presence of the following polymer (S).

Polymer (S): A polymer which is insoluble in said medium and which has a carboxyl group, hydroxyl group or amide group.

Monomer (A): A monomer which is soluble in said medium and insolubilized upon polymerization.

Monomer (C): A monomer which has at least two polymerizable unsaturated double bonds.

The high insulation hydrocarbon media used in this invention which are liquids having an electric resistance of $10^9$ Ω·cm or more and a permittivity of 3.5 or less include n-paraffinic hydrocarbons, iso-paraffinic hydrocarbons, alicyclic hydrocarbons, halogenated aliphatic hydrocarbons and the like. In view of safety and volatility, practically preferred are Shell Sol 71 (Shell Petroleum Co.), Isopar-O, Isopar-H, Isopar-K, Isopar-L and Isopar-G (Isopar is a trade name for Exxon Co.), IP Solvent (Idemitsu Petro Chemical Co.), etc. which are iso-paraffinic hydrocarbon solvents.

Construction of resins use in the liquid developer of this invention and mechanism of formation of resin dispersion (referred to as "emulsion" hereinafter) will be explained below.

The polymer (S) insoluble in said solvents and having a carboxyl group, hydroxyl group or amide group will be called "shell polymer". Polymer of the monomer (A) soluble in said solvents and insolubilized upon polymerization will be called "polymer P1".

In the first construction of this invention, the most general state before formation of emulsion, namely, before initiation of polymerization is the state where the solvent, shell polymer and monomer (A) or additionally, monomer (C) are collectively mixed. (Each of these materials may be used in combination of two or more in order to control properties of produced emulsion particles, such as Tm, Tg, etc.). Further, the monomer may be divided and then added, respectively in order to control heat generation during polymerization.

Mechanism of formation of emulsion particles may be roughly classified into two. The first is the case where the state before polymerization is homogeneous system. In this case, it is because the shell polymer dissolved in the monomer (A) that the homogeneous system is present in spite of the fact that the shell polymer is essentially insoluble in the solvent.

When this system is heated and a polymerization initiator is added thereto, radical is formed and polymerization is started. The polymer P1 component produced from monomer (A) is insoluble in the solvent and so forms particles with the shell polymer component as protective colloid to become cloudy and to form an emulsion.

As the polymerization proceeds, the shell polymer cannot be homogeneously dissolved in the system because the monomer in which the shell polymer is solubilized is consumed as polymer. Therefore, thus, the shell polymer is insolubilized. Actually, the shell polymer deposits on the surface of the emulsion particles formed by the polymer P1.

As mentioned hereinafter, the shell polymer comprises a monomer component having functional group such as carboxyl group, hydroxyl group or amide group and a monomer component soluble in said solvent upon polymerization. Therefore, the latter component contributes to dispersion stabilization.

When monomer (C) having at least two polymerizable unsaturated double bonds is charged together before polymerization, gelation of the whole polymerization system often occurs. In such case, when monomer (C) is gradually added dropwise at the time of starting of opacification with formation of emulsion particles, there are produced particles which form internal cross-linked structure.

The second mechanism of formation of emulsion particles is the case where the state before the polymerization is heterogeneous system. In this case, the polymerization may be initiated as it is, but preferably, the system is converted to a homogeneous system by adding thereto an auxiliary solvent of relatively low boiling point. When the auxiliary solvent is distilled out after completion of polymerization, the shell polymer deposits on the surface of the emulsion particles. In case too much auxiliary solvent being required, homogeneous emulsion may not be produced.

As examples of the auxiliary solvents, mention may be made of tetrahydrofuran, ethyl alcohol, isopropyl alcohol, methyl ethyl ketone, ethyl acetate, etc.

The most preferred final form of emulsion is such that the shell polymer is localized on the surface of the obtained emulsion particles. In other words, the surface of the particles is modified with polymer having carboxyl group, hydroxyl group or amide group.

In the second construction of this invention, dispersion stability of emulsion is superior to that in the first construction. The second construction of this invention will be explained in detail below.

The second construction of this invention is a liquid developer for electrostatic photography comprising a high insulation hydrocarbon medium and resin particles which are at least dispersed in the medium, wherein said resin is a resin dispersion obtained by polymerization of the following monomer (A) and monomer (B) or additionally monomer (C) in the presence of the following polymer (S).

Polymer (S): A polymer which is insoluble in said solvent and having carboxyl group, hydroxyl group or amide group.

Monomer (A): A monomer soluble in said medium and insolubilized upon polymerization.

Monomer (B): A monomer which is soluble in said medium and forms soluble polymer even upon polymerization.

Monomer (C): A monomer having at least two polymerizable unsaturated double bonds.

The high insulation hydrocarbons used in this invention which are liquids having an electric resistance of $10^9$ Ω·cm or more and a permittivity of 3.5 or less include normal paraffinic hydrocarbons, isoparaffinic hydrocarbons, alicyclic hydrocarbons, halogenated aliphatic hydrocarbons, etc. Considering safety and volatility, practically preferred are Shell Sol 71 (Shell Oil Co), Isopar-O, Isopar-H, Isopar-K, Isopar-L, Isopar-G (Isopar is a trade name of Exxon Co.), IP Solvent (Idemitsu Petrochemical Industries, Ltd.), etc.

The second construction of this invention is different in the use of monomer (B) from the first construction. Mechanism of formation of emulsion will be explained below.

The polymer (S) which is insoluble in said solvents and has carboxyl group, hydroxyl group or amide group will be called "shell polymer". Polymer of monomer (A) which is soluble in said solvents and insolubilized upon polymerization will be called "polymer P1" and polymer of monomer (B) which is soluble in said solvents and is still soluble in the solvents upon polymerization will be called "polymer P2". The most general embodiment of the emulsion used in this invention before polymerization is the state where said solvent, shell polymer, monomer (A), and monomer (B) or additionally monomer (C) are mixed together. (Each of these materials may be used in combination of two or more in order to control the properties of the obtained emulsion particles such as Tm, Tg, etc.) Further, in order to control heat generation during polymerization, the monomers used may be divided and then added.

There are two mechanisms of formation of emulsion particles as in the first construction. The first is the case where the state before initiation of said polymerization is a homogeneous system. In this case, that the homogeneous system is formed in spite of the fact that the shell polymer is essentially insoluble in the solvent is because the shell polymer is dissolved in monomer (A) or monomer (B).

When this system is heated and a polymerization initiator is added thereto, radical is formed and polymerization starts. Since the polymer P1 component produced from monomer (A) is insoluble in the solvents, it forms particles with polymer P2 soluble in the solvent as protective colloid to become cloudy and produce an emulsion.

As the polymerization proceeds, the shell polymer cannot be homogeneously dissolved in the system because the monomers in which the shell polymer is solubilized are consumed as polymer and thus the shell polymer becomes insolubilized. However, actually, the shell polymer deposits on the surface of emulsion particle formed by polymer P1.

When the monomer (C) which has at least two polymerizable unsaturated double bonds is charged together before the polymerization, the whole polymerization system is often gelled. In such case, when the monomer (C) is added gradually and dropwise at the time of emulsion particles being formed and opacification starting, there are formed particles which form internal crosslinked structure. The degree of crosslinking depends on the kind and amount of monomer (C). The ratio of copolymerization reactivity of monomer (C) and monomers (A) and (B) is also an important factor which determines the degree of crosslinking.

Sedimentation stability and particle size of the emulsion depend on the kind and amount of the shell polymer, too and when shell polymer is too much, precipitation is apt to occur. In this case, however, dispersion stability can be improved by increasing the amount of monomer (B).

Although it depends on the kind and the amount of monomer (A) and monomer (B) and the kind of the shell polymer as mentioned before, amount of the shell polymer is 1–50% by weight, preferably 3–25% by weight of monomer (A).

Particle diameter can be relatively freely changed depending on the amount of polymer P2 component, namely, amount of the charged monomer (B). The ratio of amounts of the charged monomer (A)/monomer (B) depends, of course, on solubility or cohesiveness of the produced polymer produced in the solvents, and relatively stable emulsion is obtained within the range of 98/2–20/80 by weight ratio and preferred is about 95/5–50/50.

The particle diameter depends mostly on solubility parameter of the produced polymer and solvents and so the particle diameter can be controlled by suitable selection of them.

Therefore, the produced emulsion particles are considered to have the three layer structure comprising a core layer composed of polymer P1 as an innermost portion, a shell layer composed of shell polymer deposited on said core layer and a disperse layer as outermost portion which is mainly composed of polymer P2 and stabilizes the particles in the solvent. As is understood from the mechanism of formation of the particles, of course, there are no clear interfaces between these layers and it is supposed that each component is localized in the form of three layers. When monomer (C) is used, the innermost polymer P1 forms crosslinked core layer.

The degree of crosslinking of emulsion particles affects the fixing temperature of toner images formed by development. That is, particles of a high density crosslinked structure require higher fixing temperature and thus have problems in practical use. Although it depends on kind of monomer (C), amount of monomer (C) is 0.1–20%, preferably 0.5–5% by weight of monomer (A).

In many cases, internal crosslinked structure is desired for dispersion stability. That is, there is obtained good emulsion when there is selected such monomer (C) which is readily copolymerized with monomer (A) which is insolubilized to form particles, but is not readily copolymerized with monomer (B) which is soluble in the solvent even after forming a polymer is selected.

The second mechanism of formation of emulsion particles is the case when the state before initiation of the polymerization is a heterogeneous system. In this case, the polymerization may be started as it is, but it is preferred to convert the system to a homogeneous system by adding auxiliary solvent of relatively low boiling point. As in the first mechanism of formation, when polymerization is started, there is formed a cloudy emulsion mainly composed of polymer P1 component with polymer P2 component as protective colloid. When the auxiliary solvent is distilled off after completion of the polymerization, shell polymer deposits on the surface of the emulsion particles. In case too much auxiliary solvent is necessary, homogeneous emulsion may not be formed.

As examples of the auxiliary solvents, mention may be made of tetrahydrofuran, ethyl alcohol, isopropyl alcohol, methyl ethyl ketone, ethyl acetate, etc.

The shell polymer used in this invention must have carboxyl group, hydroxy group or amide group and must be insoluble in high insulation hydrocarbon medium. Furthermore, the shell polymer is preferably soluble in a monomer which is solubilized upon polymerization and hence, copolymers of various compositions may be selected depending on monomer (A) and monomer (B) used. The most desirable final form of the emulsion is such that the shell polymer is localized on the surface of the produced emulsion particles. In other words, the surface of the particles is modified with polymer having carboxyl group, hydroxyl group or amide group.

Monomer component which constitutes the shell polymer having such action, namely, polymer (S) used in this invention preferably has the monomer represented by the general formula [I].

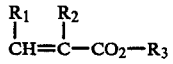

General formula [I].

wherein $R_1$ and $R_2$ represent hydrogen, alkyl group, $-COOR_4$ or $-CH_2COOR_5$ in which $R_3$, $R_4$ and $R_5$ represent aliphatic groups which may have substituent.

Monomers represented by the general formula [I] are esters of unsaturated carboxylic acids such as acrylic acid, methacrylic acid, crotonic acid, maleic acid, itaconic acid, etc. As examples of esters of aliphatic group, mention may be made of methyl, ethyl, propyl, butyl, amyl, hexyl, ethylhexyl, dodecyl, tridecyl, hexadecyl, docosanyl, hexadecenyl, oleyl esters, etc These may be substituted with halogen atom, amino group, alkoxy group, etc.

As monomers having carboxyl group which constitute polymer (S), there may be used, for example, those represented by the following general formula [II].

General formula [II]:

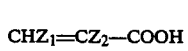

wherein $Z_1$ and $Z_2$ represent hydrogen, methyl group, $-CH_2COOH$ group or $-COOH$ group.

The monomers represented by the general formula [II] include, for example, unsaturated carboxylic acids such as acrylic acid, methacrylic acid, crotonic acid, itaconic acid, maleic acid, fumaric acid, etc.

Monomers having hydroxyl group which constitute polymer (S) are, for example, those represented by the following general formula [III].

General formula [III]:

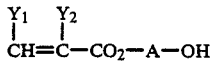

wherein $Y_1$ and $Y_2$ represent hydrogen or methyl group and A represents a hydrocarbon group which may have substituent, oxyethylene group or oxypropylene group.

The monomers represented by the general formula [III] are esters of unsaturated carboxylic acids such as, for example, acrylic acid, methacrylic acid, crotonic acid, etc. which have hydroxyl group. As examples of them, mention may be made of hydroxymethyl methacrylate, hydroxyethyl methacrylate, hydroxypropyl methacrylate, hydroxyoctyl methacrylate, hydroxymethyl acrylate, hydroxyethyl acrylate, hydroxypropyl acrylate, hydroxyoctyl acrylate, polyethylene glycol methacrylate, polyethylene glycol acrylate, polypropylene glycol methacrylate, polypropylene glycol acrylate, hydroxyethyl crotonate, etc. and these esters substituted with halogen for hydrogen atom.

As monomers having amide group which constitute polymer (S), there may be used, for example, those represented by the general formula [IV].

General formula [IV]:

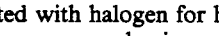

wherein $Q_1$ and $Q_2$ represent hydrogen or alkyl group and $R_1$ and $R_2$ represent aliphatic groups which may have substituent.

Monomers represented by the general formula [IV] include, for example, acrylamide, methacrylamide, N-isopropylacrylamide, N-tert-butylacrylamide, N,N-dimethylacrylamide, etc. As further examples of the monomers having amide group, mention may be made of acrylpiperidine, acrylmorpholine, acrylpyrroridine, phenylmethacrylamide, N-anisylmethacrylamide, N-tolylmethacrylamide, N-chlorophenylacrylamide, N-nitrophenylmethacrylamide, N-methacryl-α-aminoketone, N-methylolmethacrylamide and esters thereof, N-β-cyanoethylmethacrylamide, diacetoneacrylamide, etc.

Above are examples of monomers which constitute polymer (S), namely, shell polymer, but it is important for shell polymer that it has carboxyl group, hydroxyl group or amide group. Therefore, monomers usable are not limited to those of general formulas [I], [II], [III] and [IV]. For example, monomers disclosed in "Synthetic High Polymers" (Asakura Shoten Co.), "High Polymer Data Handbook" (Baifukan Co.), etc. may be used.

Furthermore, in order to adjust properties of shell polymer, it may be copolymerized with copolymerizable monomers as a third component or the above monomers may be used in combination of two or more. Moreover, a plurality of polymers may be used as the shell polymer.

The shell polymer can be obtained by known polymerization method, but since emulsion is prepared using the shell polymer as starting material, it is most preferred to produce it in a solvent same as or well miscible with the solvent used in preparation of emulsion. Further, shell polymer which is dissolved in the solvent at high temperature is not preferred because there is the possibility that characteristics of the obtained liquid developer depends on temperature and especially when temperature rises, the shell polymer is desorbed to change properties of toner particles.

Examples of copolymers used as shell polymers in this invention are enumerated below, but the shell polymers used in this invention are not limited to them. The ratio in parentheses is weight ratio.

(1) n-Hexyl methacrylate-methacrylic acid (94/6)
(2) Lauryl acrylate-acrylic acid (93/7
(3) Stearyl methacrylate-methacrylic acid (88/12)
(4) Stearyl methacrylate-vinyl acetate-crotonic acid (90/8/2)
(5) Cyclohexyl methacrylate-methacrylic acid
(6) Lauryl acrylate-vinyl acetate-maleic anhydride (92/6/2)
(7) Lauryl acrylate-butyl methacrylate-methacrylic acid (45/50/5)
(8) n-Hexyl methacrylate-hydroxyethyl methacrylate (93/7)
(9) 2-Ethylhexyl methacrylate-hydroxyethyl acrylate (95/5)
(10) n-Butyl acrylate-lauryl methacrylate-hydroxy ethyl acrylate (40/57/3)
(11) Stearyl methacrylate-hydroxyisopropyl methacrylate (90/10)
(12) Ethyl methacrylate-lauryl acrylate-hydroxyethyl acrylate (10/85/5)
(13) Vinyl acetate-n-hexyl methacrylate-hydroxypropyl methacrylate (10/87/3)
(14) Cyclohexyl methacrylate-hydroxyethylacrylate (92/8)
(15) n-Hexyl methacrylate-acrylamide (96/4)
(16) Stearyl methacrylate-methacrylamide (95/5)
(17) Stearyl methacrylate-N,N-dimethylacrylamide (90/10)
(18) Lauryl methacrylate-phenylacrylamide (95/5)
(19) n-Hexyl acrylate-diacetoneacrylamide (92/8)
(20) Stearyl methacrylate-N-isopropylacrylamide (95/15)

As examples of monomer (A) which is soluble in the solvent and is insolubilized upon polymerization, mention may be made of vinyl esters or allyl esters of acetic acid, propionic acid, butyric acid, etc., alkyl esters of itaconic acid, maleic acid, crotonic acid, etc. (of 4 or less carbon atoms because polymers of long chain alkyl are solubilised), lower alkyl esters or amides of acrylic acid or methacrylic acid which may have substituent, styrene derivatives such as styrene, methyl styrene, vinyl toluene, etc., heterocyclic compounds such as N-vinylpyrrolidone, N-vinyloxazolidone, etc. In order to adjust the properties of the obtained emulsion particles, a second copolymerizable component such as basic monomers, monomers having ether bond, etc. may be copolymerized therewith.

Monomer (B) which is soluble in the solvent and provides still soluble polymer upon polymerization is represented, for example, by the following general formula [V].

General formula [V]:

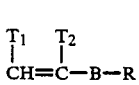

wherein R represents an aliphatic group of at least 8 carbon atoms, B represents an ester group or an amide group and $T_1$ and $T_2$ represent hydrogen atom, alkyl group, —COOR′, or —$CH_2$COOR″ where R′ and R″ represent aliphatic group.

As examples of monomer (B), mention may be made of esters and amides of acrylic acid, methacrylic acid, crotonic acid, maleic acid, itaconic acid, etc., in case of, for example, aliphatic group, mention may be made of decyl, dodecyl, tridecyl, hexadecyl, docosanyl, hexadecenyl, oleyl, etc.

These may be substituted with halogen atom, amino group, alkoxy group, hydroxy group, etc.

Necessary characteristics of monomers (A) and (B) are preferably to dissolve said shell polymer, but are not necessarily required to dissolve the shell polymer and there is no problem if substantially homogeneous system is formed upon mixing of the solvent, shell polymer, monomers (A) and (B). When dissolvabilty is low and heterogeneous system is formed, an auxiliary solvent of relatively low boiling point is used and this is distilled off after completion of polymerization.

Polymer (C) having at least two polymerizable unsaturated double bonds is a monomer having at least two vinyl groups or allyl groups in the molecule and is copolymerizable with monomer (A) or monomer (B) to form crosslinked structure. These monomers having at least two polymerizable unsaturated double bonds are generally well known and examples thereof are as follows.

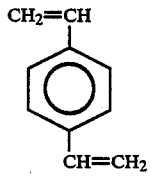
(a)

$CH_2{=}CH{-}CO_2CH{=}CH_2$ (b)

$CH_2{=}CH{-}OCOCH_2CH_2OCOCH{=}CH_2$ (c)

$CH_2{=}CH{-}OCO{-}(CH_2)_4{-}OCOCH{=}CH_2$ (d)

$CH_2{=}CH{-}COO{-}(CH_2)_2{-}OCO{-}(CH_2)_2{-}COOCH{=}CH_2$ (e)

$CH_2{=}CH{-}CONH{-}(CH_2)_4{-}COOCH{=}CH_2$ (f)

$CH_2{=}C(CH_3){-}COO{-}(CH_2)_2{-}OCO{-}(CH_2)_2{-}COOCH_2CH{=}CH_2$ (g)

$CH_2{=}C(CH_3){-}CONHCH_2CH{=}CH_2$ (h)

$CH_2{=}CH{-}COO{-}(CH_2)_4{-}OCH{=}CH_2$ (i)

-continued $CH_2{=}C(CH_3){-}COOCH_2CH_2OOCC(CH_3){=}CH_2$ (j)

$CH_2{=}CH{-}COOCH_2{-}C(CH_2OH)(CH_2OOCCH{=}CH_2){-}CH_2OOCCH{=}CH_2$ (k)

$CH_2{=}C(CH_3){-}COO{-}(CH_2CH_2{-}O)_2{-}OCC(CH_3){=}CH_2$ (l)

Furthermore, there may be used polyfunctional monomers as illustrated in "Synthetic High Polymer" (Asakura Shoten Co.), "High Polymer Data Handbook", etc. In addition, there may be also used such monomers as disclosed in Japanese Patent Unexamined Publication Nos. 114549/84, 114550/84, 185962/85, 185963/85, 249156/85, 249158/85, 250020/85, 252367/85, 254055/85, 262174/85, 60713/86, 61171/86, 112161/85, 164757/85, 209460/85, 217069/86, etc. Of course, polymer (C) is not limited to these monomers.

The emulsion prepared in this invention can be made to a liquid developer for electrostatic photography by coloring and charging the dispersed resin particles. As the coloring agents for the dispersed particles, there may be optionally used those generally known as coloring agents for liquid developer. As examples thereof, mention may be made of oil-soluble dyes such as Oil Black, Oil Red, etc., basic azo dyes such as Bismarck Brown, etc., acidic azo dyes such as Wool Black, Amido Black Green, Blue Black HF, etc., direct dyes such as Congo Red, etc., anthraquinone dyes such as Sudan Violet, Acid Blue, etc., carbonium dyes such as Auramine, Malachite Green, Crystal Violet, Victoria Blue, etc., rhodamine dyes such as Rhodamine B, quinoneimine dyes such as Safranine, Nigrosine, Methylene Blue, etc.. As pigments, mention may be made of carbon black, Phthalocyanine Blue, Phthalocyanine Green, Watchung Red, Benzidine Yellow, etc. Furthermore, there may be used surface-treated pigments such as carbon black and graft carbon dyed with Nigrosine, silicon oxide fine powders and Microlith Blue dyed with Rhodamine H.

Most convenient method for coloring of dispersed particles comprises previously dissolving a coloring agent in a solvent and adding dropwise this coloring agent solution to the emulsion and stirring it. Especially, use of a solution of an oil soluble dye in an aromatic solvent such as toluene or xylene can result in good coloring. The used solvent is not necessary to be removed so long as it does not have bad effect o quality because it is mixed with toner solvent. The solvent system as disclosed in Japanese Patent Unexamined Publication No. 48738/79 may be used and this may be removed later.

Furthermore, the particles may be colored by incorporation of the obtained emulsion and a colorant in a dispersing device such as colloid mill, ball mill, vibration mill or the like to give them mechanical vibration.

Positively charged toners and negatively charged toners can be freely prepared by selection of charge control agents, colorants, etc.

The charge control agents used in the liquid developer of this invention include copper oleate, cobalt naphthenate, zinc naphthenate, manganese naphthenate, cobalt octylate, lecithin, sodium dioctylsulfosuccinate, aluminum salt of staybelite resin, etc.

Moreover, there may be used such charge control agents as disclosed in Japanese Patent Examined Publication Nos. 26594/74 and 26595/74, Japanese Patent Unexamined Publication Nos. 173558/85, 175060/85, 179750/85, 182447/85 and 218662/85 and Japanese Patent Application No. 78062/85.

The liquid developer obtained in this invention may also be used for making lithographic printing plates as disclosed in Japanese Patent Examined Publication Nos. 17162/62, 6961/63, 2426/66, and 39405/71 and Japanese Patent Unexamined Publication Nos. 19509/75, 19510/75, 145538/79, 89801/79, 134632/79, 19803/79, 105244/80, 161863/82, 76843/83, 76844/83, 122897/83, 118658/83, 170862/84, 194467/85, 32861/86, 49895/86, 67869/86, 149399/86, etc. The liquid developers must have resist property against alkali dissolving-out solution when used in these lithographic printing plates. The liquid developers of this invention prepared using monomer (C) comprise internally crosslinked particles and the formed toner image has especially strong alkali resistance.

According to this invention, there may be provided liquid developers usable for all alkali dissolving-out solutions of weak alkali type mainly composed of aminoalcohol, strong alkali type comprising inorganic alkalis such as sodium hydroxide, potassium hydroxide, etc., those using penetrant such as benzyl alcohol, etc. and as a result, there may be provided good printing plates.

PREPARATION EXAMPLE 1

(Preparation of emulsion of this invention)

A 40% solution of n-hexylmethacrylatemethacrylic acid copolymer [shell polymer (1) mentioned above] was prepared by the known solution polymerization.

35 g of this solution was added to 1 l of hexane to give precipitate of the copolymer as a slurry. This slurry which had been subjected to washing and decantation of several times was charged in a one literfour-necked flask provided with an $N_2$ gas introduction pipe, a thermometer, a stirrer and a cooling tube and 450 g of IP solvent (Idemitsu Petrochemical Co.). At this stage, the copolymer was not dissolved at all in IP Solvent even if it was well stirred and remained as precipitate. Then, 136 g of vinyl acetate [monomer (A)] and 30 g of lauryl methacrylate (monomer (B)] were added thereto and well stirred to obtain a transparent homogeneous solution. This was purged with $N_2$ gas at 80° C. and then 1 g of azobisisobutyronitrile (AIBN) was added as a polymerization initiator to initiate polymerization. After about 50 minutes, the solution began to turn cloudy and inner temperature rose to 115° C. After the inner temperature decreased to 80° C., heating was effected for further 2 hours. The inner pressure was reduced to remove the remaining vinyl acetate monomer to obtain about 2 g of distillate. The obtained white emulsion contained no precipitate and had substantially no odor of monomer. The emulsion particles had a particle diameter of 0.28μ measured by an electron microscope and had substantially no particle size distribution.

PREPARATION EXAMPLES 2-9

In the same manner as in Preparation Example 1, emulsions were prepared with the compositions as shown in the following table. Shell polymer is indicated by "S" and amount is in terms of solid content. Monomer (A) and monomer (B) are indicated by "A" and "B", respectively. In preparation Examples 3 and 4, 20 g of methyl ethyl ketone was used as an auxiliary solvent.

| Preparation Example No. | Composition | Amount (g) |
|---|---|---|
| 2 | S: (1) | 8 |
| | A: Vinyl acetate | 123 |
| | B: Stearyl methacrylate | 37 |
| 3 | S: (2) | 10 |
| | A: Vinyl acetate | 136 |
| | B: Lauryl methacrylate | 24 |
| 4 | S: (3) | 15 |
| | A: Vinyl propionate | 177 |
| | B: Stearyl methacrylate | 31 |
| 5 | S: (4) | 15 |
| | A: Vinyl butyrate | 180 |
| | B: 2-Ethylhexyl acrylate | 40 |
| 6 | S: (2) | 8 |
| | A: Vinyl propionate | 140 |
| | A: Methyl crotonate | 24 |
| | B: Lauryl methacrylate | 29 |
| 7 | S: (6) | 20 |
| | A: Vinyl acetate | 124 |
| | A: Crotonic acid | 8 |
| | B: Stearyl methacrylate | 28 |
| 8 | S: (5) | 30 |
| | A: Vinyl acetate | 136 |
| | B: n-Hexyl methacrylate | 12 |
| | B: Lauryl methacrylate | 12 |
| 9 | S: (7) | 10 |
| | A: Vinyl acetate | 123 |
| | B: Lauryl methacrylate | 37 |

The emulsions obtained in these preparation examples contained substantially no precipitates, which did not increase even after left to stand for several months. Thus, these emulsions were stable. Particle diameter of the emulsions measured by electron microscope was about 0.15–0.3μ, although it depended on the emulsions. However, each emulsion showed particle size distribution of nearly monodisperse system. There were neither coarse particles nor fine particles and the emulsions had very uniform particle diameters. Replica method was employed for measurement of particle size of emulsions which could not be observed due to fusion bonding of the particles at room temperature.

COMPARATIVE PREPARATION EXAMPLE 1

(Preparation of comparative emulsion)

A 40% hexane solution of stearyl methacrylatemethacrylic acid copolymer (98/2 in weight ratio) was prepared by known solution polymerization method. 70 g of this polymer solution and 450 g of IP Solvent were charged in a four necked flask in the same manner as in Preparation Example 1 to obtain a homogeneous and transparent solution. (This polymer was not the shell polymer, but a soluble polymer used in the conventional methods.)

Then, in the same manner as in Preparation Example 1, monomer was added and polymerization was effected, resulting in increase of inner temperature to 105° C. The remaining monomer was distilled off to obtain a white emulsion. This emulsion contained no precipitate and had substantially no odor of monomer. The emulsion particles had a particle diameter of 0.2μ and had no particle diameter distribution. The emulsion had neither inner crosslinked structure nor the component corresponding to (S).

EXAMPLE 1

(Preparation of positively chargeable liquid developer)

To 250 g of the emulsion obtained in Preparation Example 1 was added dropwise 5 g of Oil Black HBB (manufactured by Orient Chemical Co.) dissolved in 40 g of xylene under application of ultrasonic to color the emulsion particles. Then, thereto was added 10 g of xylene solution containing of an aluminum salt of Staybelite resin as a charge control agent to obtain concentrated toner.

This concentrated toner was diluted to 10 l in total with Isopar G to obtain a positively chargeable liquid developer (toner P-1).

EXAMPLE 2

(Preparation of negatively chargeable liquid developer)

A concentrated toner was obtained in the same manner as in Example 1 except that 0.35 g of sodium salt of dioctylsulfosuccinate was used as a charge control agent for negative charging. Thus obtained concentrated toner was diluted to totally 10 l with Isopar G to obtain a negatively chargeable liquid developer (toner N-1).

EXAMPLE 3

In the same manner as in Example 1, positively chargeable liquid developers were prepared using the emulsions obtained in Preparation Examples 2–9. The resulting developers were good positively chargeable liquid developers, although the particles were somewhat different in chargeability. (Toners P-2~P-9).

EXAMPLE 4

In the same manner as in Example 2, negatively chargeable developers were prepared using the emulsions obtained in Preparation Examples 2–9. These were good negatively chargeable liquid developers, though the particles were somewhat different in chargeability. (Toners N-2~N-9).

COMPARATIVE EXAMPLE 1

(Preparation of comparative liquid developer)

In the same manner as in Example 1, positively chargeable liquid developer was prepared using the emulsion obtained in Comparative Preparation Example 1 and in the same manner as in Example 2, a negatively chargeable liquid developer was prepared using the emulsion obtained in Preparation Example 1. (Comparative toners P-1 and N-1)

EXAMPLE 5

Electrophotographic direct printing plates LOM-IIB were made by EP-12 (a direct plate making machine manufactured by Mitsubishi Paper Mills Ltd.) using toner P-1 obtained in Example 1 and toners P-2~P-9 obtained in Example 3 as liquid developers. The images obtained had all definite edges and printed copies obtained using these printing plates were also beautiful. When the comparative toner P-1 obtained in Comparative Example 1 was used, blurred ghosts appeared around the image area and besides the images were apt to get out of shape. Printed copies made using this printing plate were inferior because the undesirable patterns formed on the printing plate also appeared on the prints.

EXAMPLE 6

On an aluminum plate subjected to hydrophilizing treatment was coated e-type copper phthalocyanine pigment dispersed in an acrylic resin of high acid value and was dried to obtain a printing master plate. (binder/pigment=75/25). This printing master plate was positively charged in the dark by corona charger and was exposed imagewise. The latent image was developed with toner N-2 obtained in Example 4 and then fixed by heat. After cooling, this plate was dipped in a liquid prepared by diluting DP-4 (a developer for PS plate prepared by Fuji Photo Film Co. Ltd.) with water to 10 times for 10 seconds and then washed with water. As a result, only the toner image portions remained as beautiful images and the non-image portions were completely dissolved out to obtain a printing plate.

When the above imagewise exposed plate was developed with comparative toner N-1 obtained in Comparative Example 1, there appeared blurred ghost around the image portion and the pattern of the ghost remained after the non-image portions were dissolved out with DP-4. When development was effected with toners N-3~N-9, superior printing plates were obtained and printed copies had sharp images, but the use of the comparative toner N-1 did not produce beautiful prints due to the ghost around the image portions.

Furthermore, printing master plates of B-4 size were subjected to continuous treatments with 11 of toner N-2 and comparative toner N-1. In case of the comparative toner N-1, 20th plate had much ghosts and the toner could no longer be used while toner N-2 caused no troubles even after treatment of 70 plates.

From the above Examples, it will be recognized that good printing plates and beautiful prints can be obtained by using liquid developers comprising the emulsions of this invention.

PREPARATION EXAMPLE 10

(Preparation of emulsion of this invention)

A 40% xylene solution of n-hexyl methacrylate-hydroxyethyl methacrylate copolymer [shell polymer (8)] was obtained by conventional solution polymerization method.

70 g of this solution was added to 1 l of hexane to obtain a precipitate of the copolymer as a slurry. This slurry was subjected to washing and decantation several times and was charged in a 1 l four necked flask provided with an $N_2$ gas introducing pipe, a thermometer, a stirrer and a cooling tube, followed by adding IP Solvent (Idemitsu Petrochemical Co.). At this stage, the copolymer was not dissolved at all in IP Solvent and remained as a precipitate.

Then, 128 g of vinyl acetate [monomer (A)] and 32 g of lauryl methacrylate [polymer (B)] were added and well stirred to give a homogeneous transparent solution. This was purged with $N_2$ gas at 80° C. and thereafter, 1 g of azobisisobutyronitrile as a polymerization initiator was added to start polymerization. After about one hour, it began to become cloudy and inner temperature rose to 110° C. After the inner temperature decreased to 80° C., heating was further carried out for 2 hours. The inner pressure was reduced to distill off the remaining vinyl acetate monomer to obtain about 2 g of distillate. The obtained white emulsion contained no precipitate and had substantially no odor of monomer. Particle diameter of the emulsion particles measured by an electron microscope was 0.25 and they had no particle size distribution.

PREPARATION EXAMPLES 11–18

In the same manner as in Preparation Example 10, emulsions were prepared using the compositions shown in the following table. Shell polymer is indicated by "S" and its amount is in terms of solid content. Monomer (A) and monomer (B) are indicated by "A" and "B", respectively. In Preparation Examples 15 and 17, 30 g of methyl ethyl ketone was used as an auxiliary solvent.

| Preparation Example | Compositions | Amount [g] |
|---|---|---|
| 11 | S: (9) | 20 |
| | A: Vinyl acetate | 136 |
| | B: Stearyl methacrylate | 24 |
| 12 | S: (8) | 15 |
| | A: Vinyl acetate | 136 |
| | B: Lauryl methacrylate | 24 |
| 13 | S: (10) | 25 |
| | A: Vinyl propionate | 164 |
| | B: Lauryl methacrylate | 29 |
| 14 | S: (8) | 10 |
| | A: Vinyl propionate | 140 |
| | A: Methyl crotonate | 24 |
| | B: Stearyl methacrylate | 29 |
| 15 | S: (11) | 25 |
| | A: Vinyl acetate | 128 |
| | B: 2-Ethylhexyl acrylate | 32 |
| 16 | S: (12) | 15 |
| | A: Vinyl acetate | 122 |
| | A: Crotonic acid | 6 |
| | B: Lauryl methacrylate | 32 |
| 17 | S: (14) | 40 |
| | A: Vinyl butyrate | 180 |
| | B: 2-Ethylhexyl acrylate | 40 |
| 18 | S: (9) | 25 |
| | A: Vinyl acetate | 136 |
| | B: Cyclohexyl methacrylate | 12 |
| | B: Stearyl methacrylate | 12 |

The emulsions obtained in these preparation examples were similar to those obtained in Preparation Examples 2–9.

EXAMPLE 7

(Production of positively chargeable liquid developer)

A positively chargeable liquid developer (toner P-10) was produced in the same manner as in Example 1 except that 250 g of the emulsion obtained in Preparation Example 10 was used.

EXAMPLE 8

(Production of negatively chargeable liquid developer)

A concentrated toner was obtained in the same manner as in Example 7 except that 0.7 g of sodium dioctylsulfosuccinate was used as a charge control agent for negative charging.

The resulting concentrated toner was diluted to totally 10 l with Isopar G to obtain a negatively chargeable liquid developer (toner N-10).

EXAMPLE 9

Positively chargeable liquid developers were produced in the same manner as in Example 7 using the emulsions obtained in Preparation Examples 11–18. The resulting developers were good positively chargeable liquid developers, though chargeability of the particles is somewhat different. (toners P-11~P-18).

EXAMPLE 10

In the same manner as in Example 8, negatively chargeable developers were produced using the emulsions obtained in Preparation Examples 11–18. The resulting developers were good negatively chargeable liquid developers, though they were somewhat different in chargeability of particles. (toners N-11~N-18).

EXAMPLE 11

Electrophotographic direct printing plates LOM-IIB were made by EP-12 (a direct plate making machine manufactured by Mitsubishi Paper Mills Ltd.) using toner P-10 obtained in Example 7 and toners P-11~P-18 obtained in Example 9 as liquid developers. The images formed thereon had definite edges. Printed copies obtained with these printing plates were also beautifully finished. When comparative toner P-1 obtained in Comparative Example 1 was used, there occurred blurred ghosts around the images. The images were also apt to get out of shape. Printed copies obtained with this printing plate was inferior because the undesired patterns formed on the printing plate also appeared on the prints.

EXAMPLE 12

Printing master plate was produced by coating on an aluminum plate subjected to hydrophilization treatment an ϵ-type copper phthalocyanine pigment dispersed in an acrylic resin of high acid value (binder/pigment=75/25) and drying the coating. The master plate was positively charged in the dark by a corona charger and exposed imagewise. Then, this was developed with toner N-10 obtained in Example 8 and thereafter fixed with heat. After cooling, the plate was dipped in a liquid prepared by diluting DP-4 (a developer for PS plate of Fuji Photo Film Co. Ltd.) with water to ten times for 10 seconds and then washed with water. Only the toner image portions were left as beautiful images and non-image portions were completely dissolved off to obtain a printing plate.

On the other hand, when development was effected with comparative toner N-1 obtained in Comparative Example 1, there occurred blurred ghosts around the image portions and the pattern of the ghosts remained even after the non-image portions were dissolved off by DP-4.

When development was carried out with toners N-11~N-18, good printing plates were obtained and printed copies also had sharp images while in case of comparative toner N-1, beautiful prints were not obtained due to the ghosts around the images.

Further, the master plates of B-4 size were continuously treated with 1 l of toner N-11 and comparative toner N-1. In the case of comparative toner N-1, a lot of ghosts occurred and the toner could not be used at the treatment of the 20th plate while toner N-11 showed no change even after treatment of 50 plates.

PREPARATION EXAMPLE 19

(Preparation of emulsion of this invention)

A 40% xylene solution of n-hexyl methacrylateacrylamide copolymer [shell polymer (15)] by known solution polymerization method.

30 g of this solution was added to 1 l of hexane to give a precipitate of the copolymer in the form of slurry.

This slurry was subjected to washing and decantation several times and was charged in a 1 l four necked flask provided with an $N_2$ gas introducing pipe, a thermometer, a stirrer and a cooling tube, followed by adding 450 g of IP Solvent (Idemitsu Petrochemical Co.).

At this stage, said copolymer was not dissolved at all in IP Solvent even by well stirring and remained as precipitate.

Then, 130 g of vinyl acetate [monomer (A)] and lauryl methacrylate [monomer (B)] were added and well stirred to give a homogeneous transparent solution. This was purged with $N_2$ gas at 80° C. and then 1 g of azobisisobutyronitrile (AIBN) was added as a polymerization initiator to start polymerization. After about 40 minutes, it began to become cloudy and inner temperature rose to 110° C. After the inner temperature dropped to 80° C., heating was carried out for further 2 hours. The inner pressure was reduced to distill off the remaining vinyl acetate monomer to obtain about 3 g of a distillate. White emulsion obtained contained no precipitate and had no odor of monomer. The emulsion particles had a particle diameter of 0.22μ measured by an electron microscope and had substantially no particle size distribution.

PREPARATION EXAMPLES 20–26

In the same manner as in Preparation Example 19, emulsions were prepared using the compositions as shown in the following table. Shell polymer is indicated by "S" and its amount is in terms of solid content. Monomer (A) and monomer (B) are indicated by "A" and "B", respectively. In Preparation Examples 21 and 24, 20 g of methyl ethyl ketone was used as an auxiliary solvent.

| Preparation Example | Compositions | Amount (g) |
|---|---|---|
| 20 | S: (16) | 10 |
| | A: Vinyl acetate | 130 |
| | B: Lauryl methacrylate | 20 |
| 21 | S: (17) | 20 |
| | A: Vinyl propionate | 130 |
| | B: Lauryl methacrylate | 25 |
| 22 | S: (18) | 15 |
| | A: Vinyl acetate | 130 |
| | B: Stearyl methacrylate | 15 |
| 23 | S: (19) | 10 |
| | A: Vinyl acetate | 130 |
| | B: 2-Ethylhexyl acrylate | 10 |
| 24 | S: (20) | 10 |
| | A: Vinyl acetate | 130 |
| | B: Stearyl methacrylate | 20 |
| 25 | S: (15) | 7 |
| | A: Vinyl butyrate | 130 |
| | B: Stearyl methacrylate | 15 |
| 26 | S: (16) | 20 |
| | A: Vinyl acetate | 100 |
| | A: Vinyl propionate | 30 |
| | B: Lauryl methacrylate | 30 |

Thus obtained emulsions were all similar to those obtained in Preparation Examples 2–9.

EXAMPLE 13

(Production of positively chargeable liquid developer)

To 250 g of the emulsion obtained in Preparation Example 19 was added dropwise a solution prepared by dissolving 5 g of Oil Black HBB (manufactured by Orient Chemical Co.) in 40 g of xylene under application of ultrasonic to color the emulsion particles.

Then, 8 g of a 1% xylene solution of an aluminum salt of Staybelite resin was added as a charge control agent to obtain concentrated toner.

This concentrated toner was diluted to totally 10 l with Isopar G to obtain a positively chargeable liquid developer (toner P-19).

In the same manner as above, developers were produced using the emulsions obtained in Preparation Examples 20–26. The resulting developers were good positively chargeable liquid developers, though they were somewhat different in chargeability of particles (toners P-20~P-26). These toners caused no precipitation even after left to stand for 6 months.

EXAMPLE 14

(Production of negatively chargeable liquid developer)

Concentrated toner was prepared in the same manner as in Example 13, except that 0.3 g of sodium dioctylsulfosuccinate was used as a charge control agent for negative charging.

The resulting concentrated toner was diluted to totally 10 l with Isopar G to obtain a negatively chargeable liquid developer (toner N-19). In the same manner, liquid developers were prepared using the emulsions obtained in Preparation Examples 20–26. The resulting developers were good negatively chargeable liquid developers, though they were somewhat different in chargeability of particles. (toners N-20~N-26). These toners caused no precipitation and were stable even after left to stand for 6 months.

EXAMPLE 15

Electrophotographic direct printing plates LOM-IIB were made by EP-12 (a direct plate making machine manufactured by Mitsubishi Paper Mills Ltd.) using toners P-19~P-26 obtained in Example 13 as liquid developers. The resulting printing plates had images definite in edges and printed copies obtained using these printing plates had beautiful finishes. In the case of comparative toner P-1 obtained in Comparative Example 1, the resulting images had blurred ghosts thereround and images were also apt to get out of shape. Printed copies obtained using this printing plate was inferior because the undesired patterns formed on the printing plate also appeared on the printed copies.

EXAMPLE 16

The printing master plate used in Example 1 was positively charged in the dark by a corona charger and subjected to imagewise exposure.

This was developed with toner N-19 obtained in Example 14 and then fixed with heat. After cooling, the plate was dipped in a liquid prepared by diluting DP-4 (a developer for PS plates manufactured by Fuji Photo Film Co. Ltd.) with water to ten times for 10 seconds and washed with water. Only the toner image portions remained as beautiful images and non-image portions were completely dissolved off to obtain a printing plate.

When the development was effected with comparative toner N-1 obtained in comparative Example 1, there occurred blurred ghosts around the image portions and the patterns of the ghosts remained after dissolving off the non-image portions with DP-4. When the development was carried out with toners N-20~N-26, good printing plates were obtained and printed copies had sharp images while in the case of using the comparative toner N-1, beautiful prints were not obtained due to the ghosts around the image portions.

Furthermore, the original plates of B-4 size were subjected to continuous treatment with one 1 of toner N-19 and comparative toner N-1, respectively, much ghost occurred at treatment of 20th plate in the case of comparative toner N-1 and the toner could no longer be used while toner N-19 showed no change even after treatment of 100 plates.

PREPARATION EXAMPLE 27

(Preparation of emulsion of this invention)

A 40% xylene solution of n-hexyl methacrylatemethacrylic acid copolymer [shell polymer (1)] was prepared by known solution polymerization method.

35 g of this solution was added to 1 l of hexane to give a precipitate of the copolymer in the form of a slurry.

The slurry was subjected to washing and decantation of several times and then was charged in a 1l four necked flask provided with an $N_2$ gas introducing pipe, a thermometer, a stirrer and a cooling tube, followed by adding 430 g of IP Solvent (Idemitsu Petrochemical Co.).

At this stage, said copolymer was not at all dissolved in IP Solvent and remained as precipitate even by well stirring.

Then, 136 g of vinyl acetate [monomer (A)] and 30 g of lauryl methacrylate [monomer (B)] were added thereto and well stirred to give a homogeneous transparent solution. This was purged with $N_2$ gas at 80° C. and then 1 g of azobisisobutyronitrile (AIBN) was added as a polymerization initiator to start polymerization and the solution began to become cloudy. At this stage, thereto was gradually added dropwise 20 g of a xylene solution containing 4.1 g of divinyl adipate [monomer (C)]. The addition was completed after about 20 minutes during which inner temperature rose to 118° C. Further heating was carried out for 2 hours after the inner temperature dropped to 80° C. The inner pressure was reduced to distill off the remaining vinyl acetate monomer to obtain about 25 g of a distillate. A white emulsion obtained contained no precipitate and had substantially no odor of monomer. Emulsion particles had a particle diameter of 0.23μ measured by an electron microscope and had substantially no particle size distribution.

PREPARATION EXAMPLES 28–39

In the same manner as in Preparation Example 27, emulsions were prepared using the compositions shown in the following table. Shell polymer is indicated by "S" and its amount is in terms of solid content. Monomers (A), (B) and (C) are indicated by "A", "B" and "C", respectively. In Examples 29, 35 and 38, 20 g of methyl ethyl ketone was used as an auxiliary solvent.

| Preparation Example | Compositions | Amount (g) |
|---|---|---|
| 28 | S: (1) | 8 |
| | A: Vinyl acetate | 123 |
| | B: Stearyl methacrylate | 37 |
| | C: (l) | 3.7 |
| 29 | S: (3) | 15 |
| | A: Vinyl propionate | 177 |
| | B: Stearyl methacrylate | 31 |
| | C: (d) | 3.5 |
| 30 | S: (4) | 15 |
| | A: Vinyl butyrate | 180 |
| | B: 2-Ethylhexyl acrylate | 40 |
| | C: (e) | 9 |
| 31 | S: (8) | 15 |
| | A: Vinyl acetate | 136 |
| | B: Lauryl methacrylate | 24 |
| | C: (d) | 0.7 |
| 32 | S: (8) | 10 |
| | A: Vinyl propionate | 140 |
| | A: Methyl crotonate | 24 |
| | B: Stearyl methacrylate | 29 |
| | C: (b) | 1.7 |
| 33 | S: (9) | 20 |
| | A: Vinyl acetate | 136 |
| | B: Stearyl methacrylate | 24 |
| | C: (k) | 2.7 |
| 34 | S: (10) | 25 |
| | B: Lauryl methacrylate | 29 |
| | C: (d) | 6.5 |
| 35 | S: (14) | 40 |
| | A: Vinyl butyrate | 180 |
| | B: 2-Ethylhexyl acrylate | 40 |
| | C: (f) | 9 |
| 36 | S: (16) | 10 |
| | A: Vinyl acetate | 130 |
| | B: Lauryl methacrylate | 20 |
| | C: (d) | 2.6 |
| 37 | S: (18) | 15 |
| | A: Vinyl acetate | 130 |
| | B: Stearyl methacrylate | 15 |
| | C: (j) | 2.0 |
| 38 | S: (20) | 10 |
| | A: Vinyl acetate | 130 |
| | B: Stearyl methacrylate | 20 |
| | C: (l) | 3.9 |
| 39 | S: (16) | 20 |
| | A: Vinyl acetate | 100 |
| | A: Vinyl propionate | 30 |
| | B: Lauryl methacrylate | 30 |
| | C: (c) | 2.6 |

The emulsions thus obtained were similar to those obtained in Preparation Examples 2–9.

COMPARATIVE PREPARATION EXAMPLES 2–4

Emulsions were prepared in the same manner as in Preparation Examples 27, 31 and 36, except that monomer (C) was not used. (Comparative Emulsions 2–4). These emulsions also contained no precipitation and were stable.

These emulsions comprised particles having no internal crosslinked structure.

EXAMPLE 17

(Production of positively chargeable liquid developer)

To 250 g of the emulsion obtained in Preparation Example 27 was added dropwise a solution prepared by dissolving 5 g of Oil Black HBB (Orient Chemical Co.) in 40 g of xylene under application of ultrasonic to color the emulsion particles.

Then, 12 g of a 1% xylene solution of an aluminum salt of Staybelite resin was added thereto as a charge control agent to obtain a concentrated toner. This concentrated toner was diluted to totally 10 l with Isopar G to obtain a positively chargeable liquid developer (toner P-27).

EXAMPLE 18

(Production of negatively chargeable liquid developer)

A concentrated toner was obtained in the same manner as in Example 17, except that 0.45 g of sodium dioctylsulfosuccinate was added as a charge control agent for negative charging. This concentrated toner was diluted to totally 10 l with Isopar G to obtain a negatively chargeable developer (toner N-27).

EXAMPLE 19

Positively chargeable developers were produced in the same manner as in Example 17, using the emulsions obtained in Preparation Examples 28–39. The resulting developers were good positively chargeable liquid developers, though they were somewhat different in chargeability of particles. (toners P28~P-39).

EXAMPLE 20

Negatively chargeable developers were produced in the same manner as in Example 18, using the emulsions obtained in Preparation Examples 28–39. The resultant developers were good negatively chargeable liquid developers, though they were somewhat different in chargeability of particles. (toners N-28~N-39).

COMPARATIVE EXAMPLE 2

(Production of comparative liquid developer)

In the same manner as in Example 17 for positively chargeable developers and in the same manner as in Example 18 for negatively chargeable developers, liquid developers were produced using the emulsions obtained in Comparative Preparation Examples 1–4. (Comparative toners P-1~4 and N-2~4).

EXAMPLE 21

Electrophotographic direct printing plates LOM-IIB were made by EP-12 (a direct plate making machine of Mitsubishi Paper Mills Ltd.) using toner P-27 obtained in Example 17 and P-28–39 obtained in Example 19 as liquid developers at a somewhat higher fixing temperature. The resulting printing plates all had images having definite edges. Printed copies obtained using these printing plates also had beautiful finishes. In the case of using comparative toner P-1 obtained in Comparative Example 1, there occurred blurred ghosts around the image portions and besides the images were apt to get out of shape. Furthermore, the undesired patterns of defects in the images formed on this printing plate also appeared on the printed copies to lose practical value.

EXAMPLE 22

Printing master plates were made by coating on an aluminum plate subjected to hydrophilization treatment a dispersion of ε-type copper phthalocyanine pigment in an acrylic resin of high acid value (binder/pigment=75/25) and drying the coating. These master plates were positively charged in the dark by a corona charger and subjected to imagewise exposure.

These were developed with toners N-27~39 and comparative N-1–4 obtained in Examples 18 and 20 and Comparative Examples 1 and 2 and then fixed with heat.

These plates were dipped in the following three solutions for dissolving out non-image portions for 10 seconds and then washed with water to obtain offset printing plates.

| | |
|---|---|
| Solution A | |
| 20% potassium silicate (Hani Chemical Co.) | 70 g |
| KOH | 7 g |
| Water to make up 1 l. | |
| Solution B | |
| EDTA-4H | 2 g |
| Butyl diglycol | 20 g |
| Monoethanolamine | 40 g |
| Water to make up 1 l. | |
| Solution C | |
| EDTA-4H | 2 g |
| Benzyl alcohol | 15 g |
| N—methyl ethanolamine | 30 g |
| Water to make up 1 l. | |

Evaluation was carried out by observing the state of images after fixation and those after treatment with solutions A–C.

| Toners | Images after fixation with heat | Solution A | Solution B | Solution C |
|---|---|---|---|---|
| Comparative N-1 | Ghost occurred | Ghost occurred | Thinned image | No image |
| Comparative N-2 | Good | Good | " | " |
| Comparative N-3 | " | " | " | " |
| Comparative N-4 | Ghost occurred | Ghost occurred | " | " |
| N-1~4 | Good | Good | Good | Good |
| N-5~9 | " | " | " | " |
| N-10~13 | " | " | " | " |

Use of comparative toner N-1 (with no shell polymer) resulted in defects in images after development and fixation. In the case of comparative toners N-2–4, good printing plates were obtained with use of solution A for dissolving-off of non-image portions, but toner images were also dissolved off with use of solutions B and C which were high in permeation property. This means poor resist property against the solutions for dissolving off of non-image portions. On the other hand, toners N-1–13 according to this invention comprised particles having internal crosslinked structure and so only toner images remained as beautiful images and non-image portions were completely dissolved off even with use of solutions of high permeation property to give good printing plates.

In the case of printing plates obtained using solution A, good printed copies were obtained even after printing of a hundred thousand copies excluding when comparative toner N-1 was used while in the case of printing plates obtained using solution C, only those which were obtained using toners N-1~13 of this invention could stand printing of a hundred thousand copies.

Thus, it will be understood that the emulsions of this invention which comprise particles of the three layer type having internal crosslinked structure are effective as liquid developer for electrophotography.

PREPARATION EXAMPLE 40

In a polymerization flask were charged 180 parts by weight of lauryl methacrylate, 20 parts by weight of hydroxyethyl methacrylate, 150 parts by weight of IP Solvent 1620 as a solvent and 50 parts by weight of isopropyl alcohol together with 1.5 part by weight of azobisisobutyronitrile as a polymerization initiator and the content wa sufficiently purged with nitrogen and then heated to 80° C. After 1.5 hour from initiation of polymerization, 0.5 part by weight of azobisisobutyronitrile was added, followed by heating for 3 hours and finally adding 200 parts by weight of IP Solvent 1620 to obtain a colorless transparent viscous solution of polymer (S) used in this invention. Then, 60 parts by weight of this solution was taken in a polymerization flask and 200 parts by weight of IP Solvent 1620 was added thereto to precipitate the polymer (S). Thereto were further added 60 parts by weight of methoxyethyl acrylate and 20 parts by weight of hydroxyethyl acrylate to dissolve the precipitate in the monomers to form a homogeneous system. 0.64 part by weight of azobisisobutyronitrile was added thereto and the content was sufficiently purged with nitrogen, followed by heating to 80° C. After 3 hours, the inner pressure was reduced to remove the auxiliary solvent, resulting in a translucent resin dispersion. Average diameter of the particles was 0.17 μm.

PREPARATION EXAMPLE 41

In a polymerization flask were charged 95 parts by weight of lauryl methacrylate and 100 parts by weight of IP Solvent 1620, followed by adding 0.75 part by weight of azobisisobutyronitrile and the content was sufficiently purged with nitrogen and heated to 80° C. Furthermore, to the flask was added a solution of 5 parts by weight of N-methylolacrylamide in 40 parts by weight of tetrahydrofuran, 40 parts by weight of ethanol and 100 parts by weight of methyl ethyl ketone over a period of 40 minutes. After 2 hours from initiation of polymerization, 0.25 part by weight of azobisisobutyronitrile was added, followed by heating for 3 hours to obtain a transparent and colorless viscous solution of polymer (S). Then, 80 parts by weight of this polymer solution was taken in a polymerization flask and thereto was added 200 parts by weight of IP Solvent 1620 to precipitate the polymer (S). Thereto were further added 80 parts by weight of vinyl acetate and 40 parts by weight of methyl ethyl ketone to dissolve the polymer, resulting in a homogeneous system. 0.64 part by weight of azobisisobutyronitrile was further added and the content was sufficiently purged with nitrogen, followed by heating to 80° C. After 3 hours, the pressure in the flask was reduced to remove the remaining monomer and the auxiliary solvent to obtain a resin dispersion of translucent white. Average particle diameter of particles was 0.15 μm.

PREPARATION EXAMPLE 42

In a polymerization flask were charged 180 parts by weight of lauryl methacrylate, 20 parts by weight of methacrylic acid, 200 parts by weight of IP Solvent 1620 as a solvent and 40 parts by weight of isobutyl alcohol, followed by adding 1.5 part by weight of azobisisobutyronitrile, sufficient purging with nitrogen and heating to 80° C. After 1.5 hour from initiation of polymerization, 0.5 part by weight of azobisisobutyronitrile was added, followed by further heating for 3 hours. Then, 230 parts by weight of IP Solvent 1620 was added to obtain a transparent and colorless viscous solution of polymer (S). Thereafter, 65 parts by weight of this solution was taken in a polymerization flask and 200 parts by weight of IP Solvent 1620 was added thereto to precipitate the polymer (S). Thereto were further added 80 parts by weight of vinyl acetate and 40 parts by weight of isobutyl alcohol as an auxiliary solvent to dissolve the polymer, resulting in a homogeneous system. Thereto was added 0.64 part by weight of azobisisobutyronitrile and the content was sufficiently purged with nitrogen, followed by heating to 80° C. After 3 hours, the inner pressure was reduced to remove the remaining monomer and the auxiliary solvent to obtain a resin dispersion of translucent white. Average particle diameter of particles was 0.15 μm.

EXAMPLE 23

In the same manner as in Example 1, positively chargeable liquid developers (toners P-40–42) using the emulsions obtained in Preparation Examples 40–42. Images were formed on ZnO master LOM-IIB (Mitsubishi Paper Mills Ltd.) by a plate making machine EP-12 (Mitsubishi Paper Mills Ltd.) using these toners to obtain the following results.

| Toner | Dispersion stability | Image reproducibility | Charge stability |
|---|---|---|---|
| P-40 | o | Δ | o |
| P-41 | o | o | o |
| P-42 | o | o | o |
| Comparative | | | |
| P-1 | o | x | Δ |

Image reproducibility "x" indicates that edges of images were not sharp and there occurred blurred ghosts. Change stability "Δ" indicates that charge of particles somewhat changed after use of the liquid developers for a long time (about 3 months) and "o" indicates no change in charge of particles even after use of 3 months. Dispersion stability "o" indicates the level where neither precipitation nor agglomeration occurred after lapse of 3 months.

What is claimed is:

1. A process for producing a liquid developer for electrostatic photography which comprises a highly insulating hydrocarbon medium which is a liquid having an electric resistance of $10^9$ Ω·cm or more and a permittivity of 3.5 or less and resin particles dispersed therein, said process comprising polymerizing a monomer (A) soluble in said medium, but insolubilized upon being polymerized in the presence of a polymer (S) insoluble in said medium and having a carboxyl group, a hydroxyl group or an amide group.

2. A process according to claim 1 wherein a monomer (C) having at least two polymerizable unsaturated double bonds is polymerized in addition to monomer (A).

3. A process according to claim 1 wherein a monomer (B) soluble in said medium and still soluble in said medium upon being polymerized is polymerized in addition to monomer (A).

4. A process according to claim 3 wherein a monomer (C) having at least two polymerizable unsaturated double bonds is polymerized in addition to monomers (A) and (B).

5. A process according to claim 1 or 3 wherein amount of polymer (S) is 1-50% by weight of monomer (A).

6. A process according to claim 3 wherein weight ratio of monomer (A)/monomer (B) is 98/2-20/80.

7. A process according to claim 2 or 4 wherein amount of monomer (C) is 0.1-20% by weight of monomer (A).

8. A process according to claim 1 or 2 wherein an auxiliary solvent is used.

9. A process according to claim 1 wherein the monomer constituting the polymer (S) is selected from the monomers represented by the following general formulas [II]-[IV]:

General formula [II]:

$$CHZ_1{=}CZ_2{-}COOH$$

wherein $Z_1$ and $Z_2$ represent hydrogen, methyl group, $-CH_2COOH$ group or $-COOH$ group;

General formula [III]:

$$\begin{array}{l} Y_1 \quad Y_2 \\ | \quad\;\; | \\ CH{=}C{-}CO_2{-}A{-}OH \end{array}$$

wherein $Y_1$ and $Y_2$ represent hydrogen or methyl group and A represents a hydrocarbon group which may have substituent, oxyethylene group or oxypropylene group, General formula [IV]:

$$CHQ_1{=}CQ_2{-}CONR_1R_2$$

wherein $Q_1$ and $Q_2$ represent hydrogen or alkyl group and $R_1$ and $R_2$ represent aliphatic groups which may have substituent.

10. A process according to claim 1 wherein the polymer (S) is a copolymer of a monomer of above general formula [II], [III] or [IV] with a monomer of the following general formula [I]:

$$\begin{array}{l} R_1 \quad R_2 \\ | \quad\;\; | \\ CH{=}C{-}CO_2{-}R_3 \end{array} \qquad [I]$$

wherein $R_1$ and $R_2$ represent hydrogen, alkyl group, $-COOR$ or $-CH_2COOR$ in which $R_3$, $R_4$ and $R_5$ represent aliphatic groups which may have substituent.

11. A process according to claim 1 wherein the resin particles are colored with a colorant and positively or negatively charged.

12. A liquid developer obtained by the process of claim 1 or 2.

13. An electrophotographic process which includes a step of development with the liquid developer of claim 1.

14. A method for making a lithographic printing plate according to the electrophotographic process of claim 13.

* * * * *